US005231456A

United States Patent [19]

Kikuchi et al.

[11] Patent Number: 5,231,456

[45] Date of Patent: Jul. 27, 1993

[54] IMAGE FORMING APPARATUS HAVING A DISORDERING DEVICE FOR DISORDERING A DEVELOPING AGENT REMAINING ON AN IMAGE BEARING MEMBER

[75] Inventors: Kazuhiko Kikuchi; Naruhito Yoshida, both of Kanagawa, Japan

[73] Assignee: Kabushiki Kaisha Toshiba, Kawasaki, Japan

[21] Appl. No.: 817,611

[22] Filed: Jan. 7, 1992

[30] Foreign Application Priority Data

Feb. 27, 1991 [JP] Japan ..... 3-032972

[51] Int. Cl.[5] ..... G03G 21/00

[52] U.S. Cl. ..... 355/270; 355/297; 355/299

[58] Field of Search ..... 355/270, 296, 297, 299

[56] References Cited

U.S. PATENT DOCUMENTS

| | | | |
|---|---|---|---|
| 4,400,081 | 8/1983 | Yamashita et al. | 355/299 |
| 4,690,544 | 9/1987 | Forbes et al. | 355/299 |
| 4,727,395 | 2/1988 | Oda et al. | 355/270 X |
| 4,769,676 | 9/1988 | Mukai et al. | 355/270 X |
| 5,055,882 | 10/1991 | Fushimi | 355/270 X |
| 5,066,982 | 11/1991 | Hosoya et al. | 355/270 X |

FOREIGN PATENT DOCUMENTS

| | | |
|---|---|---|
| 60-136772 | 7/1985 | Japan . |
| 64-20587 | 1/1989 | Japan . |
| 1-118878 | 5/1989 | Japan . |

*Primary Examiner*—Fred L. Braun
*Attorney, Agent, or Firm*—Foley & Lardner

[57] ABSTRACT

An image forming apparatus has a disordering device for disordering the developing agent remaining on the image bearing member after transfer of the developed image by the transfer device. The disordering device includes a conductive member positioned to rub against the image bearing member, for attracting the developing agent remaining on the image bearing member and distributing the attracted developing agent on the image bearing member so as to disorder any pattern therein. The disordering device of the present invention also has a contact member which is positioned between the disordering device and the charger, for leveling any deposits of the developing agent remaining on the image bearing member. The contact member is in sliding contact with the surface of the image bearing member in the same direction as the rotation of the image bearing member.

4 Claims, 4 Drawing Sheets

IMAGE FORMING APPARATUS HAVING A DISORDERING DEVICE FOR DISORDERING A DEVELOPING AGENT REMAINING ON AN IMAGE BEARING MEMBER

BACKGROUND OF THE INVENTION

1. Field of the Invention

This invention relates to an image forming apparatus, such as an electrophotographic printer, for forming an image on an image bearing member and, more paticularly, to an image forming apparatus having a disordering device for disordering a developing agent remaining on the image bearing member.

2. Description of the Related Art

Generally, in a conventional image forming apparatus, a latent image is first formed on an image bearing member which has had its entire surface charged by a charging device. A developing device then develops the latent image using a developing agent (toner) to make the latent image visible. Subsequently, the developed image is transferred onto a paper sheet by a transferring device. Most of the toner of the developed image on the image bearing member is transferred onto the paper sheet by the transferring device. However, some of the toner of the developed image remains on the image bearing member after transfer of the developed image by the transferring device. Thus, the residual toner particles on the image bearing member are removed from the image bearing member by a cleaning device.

Recently, in the image forming apparatus, it has been demanded by buyers to reduce the size of the apparatus to a compact type. For example, U.S. Pat. No. 4,727,395 discloses an image forming apparatus which simultaneously carries out the developing and cleaning processes. The image forming cycle of the apparatus is performed with one rotation of its image bearing member. Thus, this image forming apparatus is reduced in size by using an image bearing member having a reduced diameter and a device which serves as a developing device and a cleaning device.

However, in the image forming process described in U.S. Pat. No. 4,727,395, the residual toner image still remains in the next image forming process, for example, a charging process and a latent image forming process (an exposure process). Thus, the charging process and the latent image forming process in the next image forming cycle have to be carried out on the residual toner image remaining on the image bearing member. Therefore, a resulting image formed in the next cycle is deteriorated by the residual toner image remaining on the image bearing member.

In order to solve the above problem, U.S. Pat. No. 4,769,676 discloses an image forming apparatus having a disordering device for disordering the residual toner image remaining on the image bearing member after the transfer of the developed image and before the next image forming operation. The disordering device includes a conductive member in sliding contact with the image bearing member. The conductive member has a bias voltage applied to it. Therefore, by means of a sliding contact between the conductive member and the image bearing member, the residual toner is temporarily attracted to the conductive member and is then deposited over other parts of the surface of the image bearing member. Thereby, the disordering of the residual toner is effected and the residual toner image is made non-patterned.

However, in the image forming apparatus, the body of the apparatus vibrates in certain operations, for example, the operation for removing a jammed paper sheet from the apparatus, the operation for starting the rotation of the image bearing member and so on. By the vibration of the apparatus, the toner particles attracted on the disordering device may be lumped and removed form the disordering device. Thus, the conventional image forming apparatus described in U.S. Pat. No. 4,769,676, charging randomness and exposure randomness may be caused by any deposits of toner particles removed from the disordering device. Therefore, a resulting image formed on the image bearing member in the next image forming cycle is deteriorated.

SUMMARY OF THE INVENTION

Accordingly, it is an object of the present invention to provide an image forming apparatus wherein the effects of a developing agent remaining on an image bearing member during a charging process and a latent image forming process are prevented by a simple apparatus from lowering the quality of images formed on a paper sheet.

In order to achieve the above object, an image forming apparatus according to one aspect of the present invention having a latent image forming device for forming a latent image on an image bearing member, a developing and cleaning device for developing the latent image with a developing agent and for simultaneously removing the developing agent remaining on the image bearing member, a transfer device for transferring the developed image on the image bearing member to a recording medium, a distributing device for distributing the developing agent remaining on the image bearing member after transfer of the developed image by the transfer device and a leveling member for leveling any deposits of the developing agent remaining on the image bearing member after the member has passed the distributing means.

A further aspect of the present invention provides an image forming apparatus having a rotatable image bearing member, a charger for charging on the rotatable image bearing member, an exposing device for exposing the charged image bearing member to form a latent image on the image bearing member, a developing and cleaning device, constituted within a single unit, for developing the latent image formed on the image bearing member with a developing agent and for simultaneously removing the developing agent remaining on the image bearing member, a transfer device for transferring the developed image on the image bearing member to a recording medium and a disordering device for disordering the developing agent remaining on the image bearing member after tansfer of the developed image by the transfer device. The disordering device has a conductive member which is positioned to rub against the image bearing member, for attracting the developing agent and for distributing the attracted developing agent on the image bearing member and a contact member for leveling any deposits of the developing agent on the image bearing member after the member has passed the conductive member. The contact member is in sliding contact with the surface of the image bearing member in the same direction as the rotation of the image bearing member and is positioned on the downstream side of the conductive member in the direction of rotation of the image bearing member and on the upstream side of the charger in the direction of rotation of the image bearing member.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
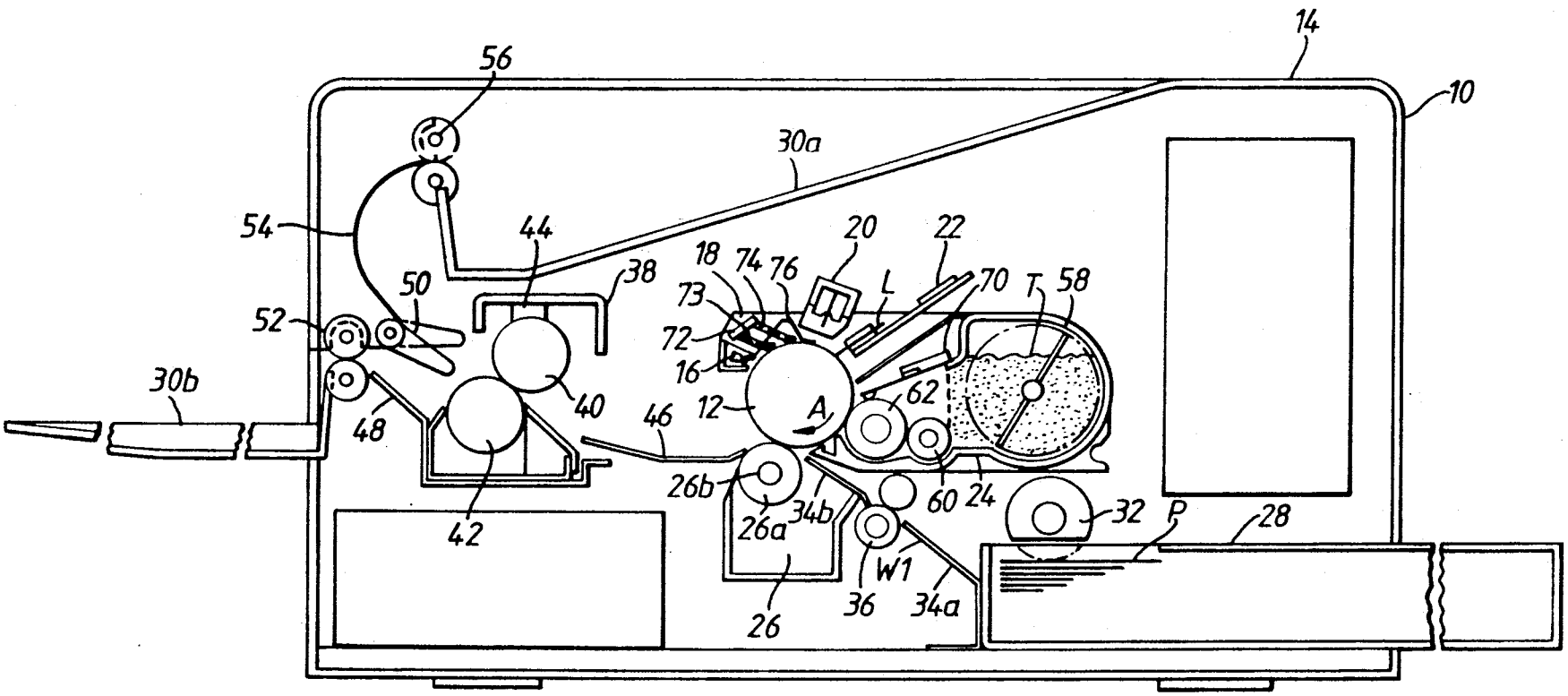
FIG. 1 is a sectional view of an image forming apparatus according to the present invention.

FIG. 1 shows an image forming apparatus according to the present invention. The image forming apparatus may be, of course, one of a wide variety known in the prior art. For purpose of example, however, the image forming apparatus depicted is a electrophotographic printer. The electrophotographic printer 10 may serve as an output device for a host computer (not shown). In response to a print command from the host computer, electrophotographic printer 10 performs an image forming operation to form an image on a paper sheet according to data supplied from the host computer.

Referring now to FIG. 1, the internal construction of electrophotographic printer 10 will be described.

Electrophotographic printer 10 includes an image bearing member 12, for example, a photosensitive drum, for forming a latent image in response to light. Image bearing member 12 is disposed substantially in the center of a body 14 and is formed of an organic photoconductor (OPC). Image bearing member 12 has a drum diameter of 40 mm and is rotated by an electric motor (not shown) in the direction of arrow A.

A discharging device 16, a disordering device 18, a charging device (a scrotron charger) 20, a latent image forming device (an exposure unit) 22, a developing and cleaning device 24 and a transfer device 26 respectively are arranged around the periphery of image bearing member 12 in the direction of its rotation.

Discharging device 16 radiates a light on the surface of image bearing member 12 in order to set the electrical potential of the surface of image bearing member 12 to a predetermined uniform level. After the electrical potential of the surface of image bearing member 12 is set, or toner distributor device 18 disorders the residual toner remaining on image bearing member 12 and then charging device 20 charges the entire surface of image bearing member 12 in order to prepare the surface for forming a latent image.

Latent image forming device 22 radiates a light beam L on image bearing member 12, so that a latent image is formed on the surface of image bearing member 12.

Developing and cleaning device 24 develops the latent image with a developing agent in order to form a visible image and remove the residual developing agent from image bearing member 12.

Transfer device 26 includes a transfer roller **26*a* which faces image bearing member 12 at an image transfer position. Transfer device 26** transfers the developed image onto a paper sheet P.

A paper supply cassette 28 is inserted into a lower portion of body 14. Cassette 28 holds a supply of paper sheet P. A first output tray **30*a* is located on the upper portion of body 14 to receive printed paper sheets P output from laser printer 10. A second output tray 30*b* is located on the side portion of body 14, so that second output tray 30*b*** may receive printed paper sheets P.

A pickup roller 32 for picking up paper sheets P from cassette 28 is provided at the top ends of cassette 28 when cassette 28 is inserted into body 14. Pickup roller 32 has a semicircular cross-section and flat surface. Paper sheet P, when picked up from cassette 28, is then transported to the image transfer position through a feeding path W1. Feeding path W1 has feeding guides **34*a* and 34*b* and a pair of aligning rollers 36**.

A fixing unit 38 is located downstream of the image transfer position. Fixing unit 38 fixes the toner image onto paper sheet P by heating and pressing paper sheet P with the toner image. Fixing unit 38 has a heating roller 40, a pressing roller 42 for pressing against heating roller 40 and a cleaner 44 for cleaning the surface of heating roller 40.

A guide 46 is located between the image transfer position and fixing unit 38. Paper sheet P from the image transfer position is transported to fixing unit 38 along guide 46. An eject path W2 is located downstream of fixing unit 38. Eject path W2 ejects paper sheet P with the fixed toner image onto output tray **30*a* or 30*b*. Eject path W2 comprises a first guide 48, a gate 50, first pair of eject rollers 52, a second guide 54 and second pair of eject rollers 56. Gate 50 selects the eject position of paper sheet P with the fixed toner image. Thereby, paper sheet P is transported to output tray 30*a* or 30*b***.

Figure 2:
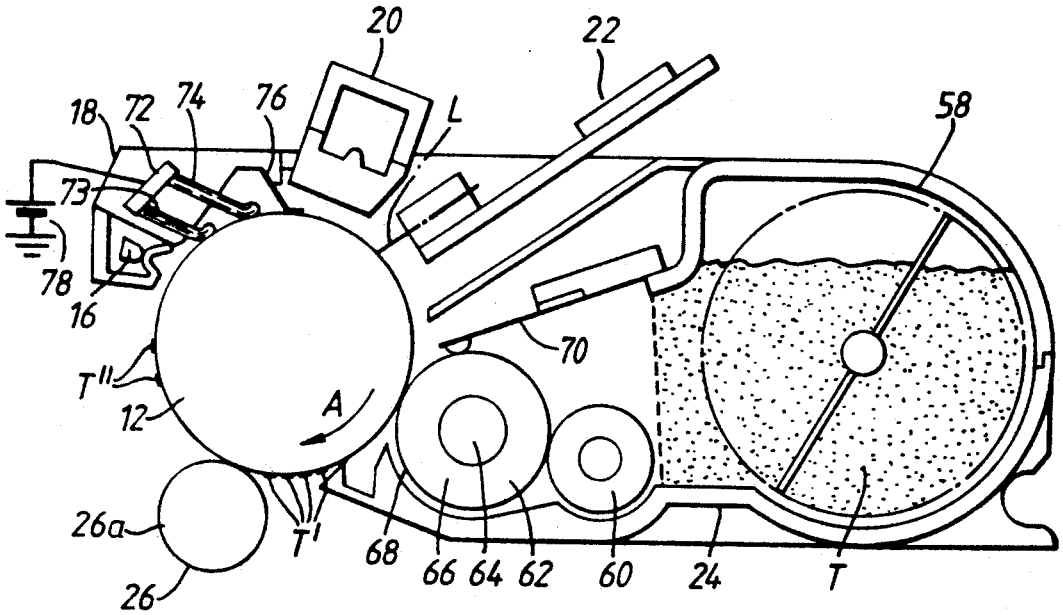
FIG. 2 is a schematic view showing the arrangement of components for performing an image forming operation on the image forming apparatus shown in FIG. 1.

Referring to FIG. 2, the image forming operation of electrophotographic printer 10 will now be described.

Image bearing member 12 is rotated in the direction of arrow A and the peripheral surface of image bearing member 12 is charged to −500 to −800 V by charging device 20. Then, the charged area is exposed by the irradiation of light beam L in response to data received from the host computer by latent image forming device 22. As a result, a latent image is formed on the surface of image bearing member 12.

The formed latent image is transported to a developing and cleaning position facing developing and cleaning device 24. Developing and cleaning device 24 includes a hopper 58, a toner feeding roller 60 and a developing roller 62. Hopper 58 stores non-magnetic one-component toner T as a developing agent. Toner feeding roller 60 transports toner T to developing roller 62 and rakes toner T to prevent a cohesion of toner T in hopper 58. Developing roller 62 supplies toner T to image bearing member 12. The latent image formed on image bearing member 12 is developed to a toner image T′ by toner T supplied from developing roller 62. In this embodiment, developing roller 62 also operates as a cleaning roller to remove residual toner T″ from image bearing member 12 and to restore residual toner T″ into hopper 58 when the formed latent image is developed.

Developing roller 62 includes a roller shaft 64, an elastic layer 66 surrounding roller shaft 64 and a conductive surface layer 68 surrounding elastic layer 66, so that developing roller 62 as a whole possesses elasticity. Elastic layer 66 is made of an elastic material with an elasticity of about 30° to 70° (JIS rubber-hardness measurement method), for example, foamed polyurethane, silicon rubber, urethane rubber or diene rubber. Conductive surface layer 68 is formed of conductive material with a resistance of $10^2$ to $10^8$ Ω·cm. Also, the material of conductive surface layer 68 is formed by coating, for example, a mixture of urethane resin with 10 to 30 weight-percent of a conductive carbon.

Developing roller 62 rotates in friction with a friction blade 70 thus causing a frictional electricity. Friction blade 70 is formed of phosphor bronze, polyurethane resin or silicon resin. Thus, toner T supplied by developing roller 62 is charged when toner T passes through between the surface of developing roller 62 and frictional blade 70, and a thin layer of toner T is formed on the surface of developing roller 62. For example, toner T is charged to about −5 to −30 μc/g by the friction of blade 70 and conductive surface layer 68 of developing roller 62. Also, developing roller 62 is connected to a bias power source (not shown). Conductive surface layer 68 of developing roller 62 is electrically connected with the bias power source. Thus, a specified developing bias is applied to the conductive surface layer.

In this case, a voltage of about −150 to −450 V is applied to developing roller 62.

Developing roller 62 makes contact with a nip width with image bearing member 12, on which the latent image has been formed, by elastic deformation, and toner image T′ is formed by causing the adherence of toner T. In this case, toner T adheres to an area which has been irradiated by light beam L.

After the developing process, toner image T′ is transported to the image transfer position which faces transfer device 26. At the same time, paper sheet P from paper supply cassette 28 is fed through feeding path W1. Transfer device 26 has transfer roller **26*a* including a rotating shaft 26*b* to which an AC bias voltage biased towards plus is applied. This voltage is applied to the surface of transfer roller 26*a* which has a surface conductivity of $10^5$ to $10^9$ Ω·cm. Thus, the reverse side of paper sheet P is applied with a bias voltage biased towards plus by transfer roller 26*a*. Toner image T′ on the surface of image bearing member 12** is electrostatically attracted to paper sheet P by the bias voltage, and is transferred onto paper sheet P.

After the transferring porcess, paper sheet P is conveyed to fixing unit 38 and toner image T′ is fixed on paper sheet P. Paper sheet P with the fixed toner image is selectively transported to output tray **30*a* or 30*b***.

The latent image remaining on image bearing member 12 after the transferring process is mostly removed by passing through discharging device 16. Also, a residual toner image T″ remaining on image bearing member 12 is transported to the area which faces disordering device 18 through discharging device 16.

Figure 3:
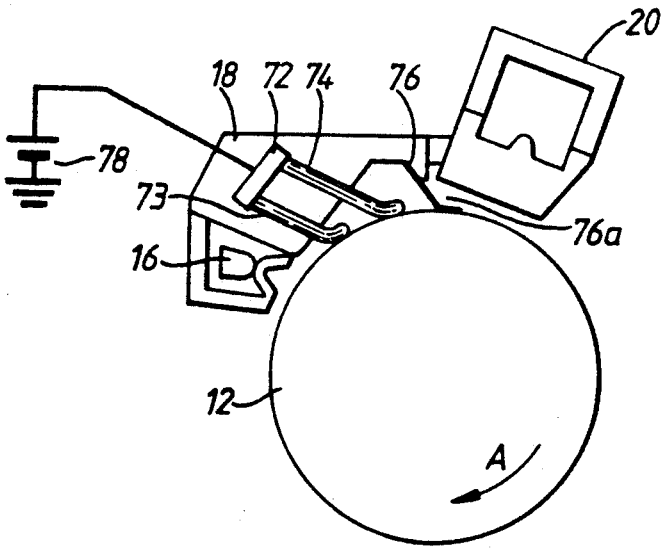
FIG. 3 is a schematic view showing the arrangement of components of the disordering device of the image forming apparatus shown in FIG. 1.

The disordering device 18 includes a conductive member 72 as the toner disordering member and a contact member 76 as shown in FIG. 3. Conductive member 72 has first and second conductive brush members 73 and 74. First and second conductive brush members 73 and 74 respectively are formed of fiber having an electrical resistance of $10^3$ to $10^9$ Ω·cm and are positioned to rub against the surface of image bearing member 12. Also, conductive member 72 is connected to a power source 78 and receives a positive AC bias voltage from power source 78. Thus, first and second conductive brush members 73 and 74 are supplied with the AC bias voltage. First and second conductive brush members 73 and 74 rub image bearing member 12 during the rotation thereof, so that residual toner particles T″ are thoroughly disordered and made non-patterned on image bearing member 12.

When an AC bias is applied to conductive member 72 of disordering device 18, the residual toner repeats forward/reverse transfer between brush member 72 and image bearing member 12. While repeating forward-/reverse transfer accompanying with the rotation of image bearing member 12, the position of the residual toner remaining on image bearing member 12 gradually changes and the toner particles remaining on image bearing member 12 are disturbed. Therefore, by applying the bias voltage with an AC component to conductive member 72, non-patterning of the residual toner may be achieved by generating repeated transfer/-reverse transfer of the residual toner. In this case, conductive member 72 receives a bias voltage which is a DC voltage of 0 to 600 V and an AC voltage of 700 to 1600 V (peak-to-peak) and changing in frequency from 300 Hz to 4 kHz.

Also, contact member 76 has a sheet-like material formed of urethane or polyethylene and so on. Contact member 76 levels any deposits of the disordered residual toner particles on the surface of image bearing member 12.

After any residual toner particles have been made non-patterned, image bearing member 12 is charged at the specified potential by charging device 20 (−500 to −800 V). At this time, the residual toner particles on image bearing member 12, which has been made non-patterned and leveled on image bearing member 12, are also given a negative charge. Developing and cleaning device 24 removes the residual toner from image bearing member 12 by developing roller 12.

In the image forming operation of laser printer 12, the above processes are repeated.

The above developing and cleaning process will now be described in more detail.

After transfer of the developed image by transfer device 26, the latent image and a small amount of toner particles which have not been transferred onto paper sheet P remain on the surface of image bearing member 12. The residual latent image is eliminated by a red LED as discharging device 16. In this case, since the residual toner shields the light from the LED, a greater quantity of discharge light is required than in a conventional apparatus having a cleaning device.

Further, any toner particles T″ remaining on image bearing member 12 are transported to disordering device 18 to be made non-patterned. As described above, in disordering device 18, residual toner particles T″ are finely disturbed to an unreadable state by the contact of conductive member 72 with residual toner T″ which exerts electrostatic and mechanical force.

Thus, residual toner particles T″ on the surface of image bearing member 12, which have passed through disordering device 18, are thoroughly distributed in a fine fog-like state and no longer have any information such as characters or an image. Residual toner particles T″ return to the charging process after having become thoroughly non-patterned.

Image bearing member 12 charged by charging device 20 is exposed, and a latent image is formed on image bearing member 12 by latent image forming device 22. In this case, residual toner particles T'' are thoroughly and thinly dispersed on the surface of image bearing member 12. Thus, no exposure randomness will occur and the residual potential of the surface of image bearing member 12 becomes uniform after exposure. Thereby, in the next developing process, a uniform toner image may be obtained, since the residual potential of the surface of image bearing member 12 becomes uniform after exposure.

The latent image formed on image bearing member 12 and residual particles T'' then reach the developing and cleaning position facing to the developing and cleaning device 24. As described above, developing and cleaning device 24 has developing roller 62 including elastic layer 66 with the elasticity of 30° to 70° and conductive surface layer 68 with the conductivity of $10^2$ to $10^8$ Ω·cm. Thus, a load of 20 to 150 g/cm is applied to developing roller 62 as a linear load, and developing roller 62 is caused to make pressure contact with a speed difference of about 1.5 to 4 times. Thereby, developing roller 62 produces a nip width of about 1 to 4 mm on the surface of image bearing member 12. Residual toner T'' on image bearing member 12 and toner T supplied by developing roller 62 are agitated and rubbed in this nip width, and a strong frictional force is generated. Also, developing roller 62 has applied thereto a predetermined developing voltage. The predetermined developing bias voltage takes an appropriate value between the residual potential of the exposed portion and the potential of the unexposed portion on developing roller 62. In the unexposed portion, the attraction due to the developing bias voltage exceeds that of image bearing member 12. Residual toner particles T'' adhering to the non-image portion (unexposed portion) are attracted to developing roller 62. Thereby, residual toner particles T'' are removed from image bearing member 12. Moreover, toner T supplied from developing roller 62 adheres to the exposed portion of image bearing member 12 by applying a predetermined developing bias voltage on developing roller 62.

In this case, there is a small quantity of residual toner remaining. The residual toner also is distributed beforehand in a fine fog by disordering device 18. Therefore, developing and cleaning device 24 may efficiently remove residual toner particles T'' on image bearing member 12.

Then, after the developing and cleaning process, the developed image formed on image bearing member 12 is transferred onto paper sheet P at the image transfer position.

The operation of disordering device 18 will be described with reference to FIG. 4.

Figure 4A:
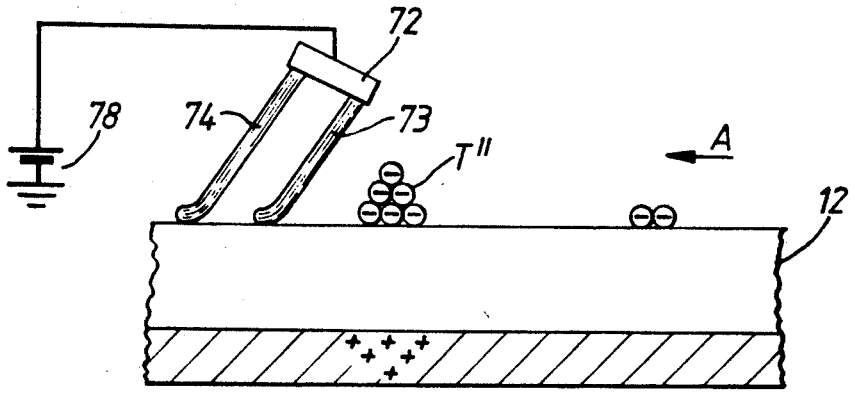
FIGS. 4(*a*)-(*c*) are diagrams showing the operation of a conductive member of the disordering device shown in FIG. 3.
Figure 4B:
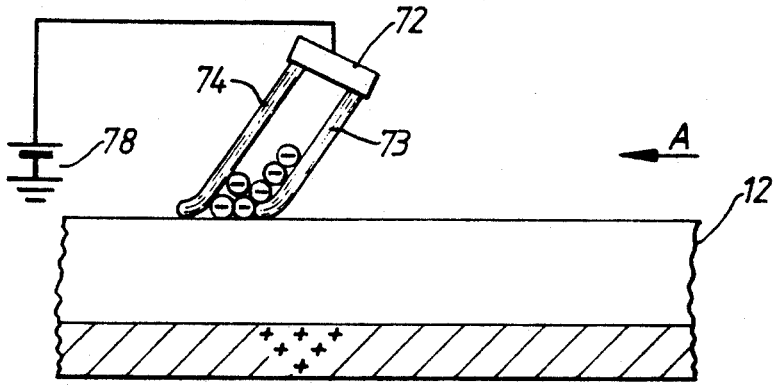
Figure 4C:
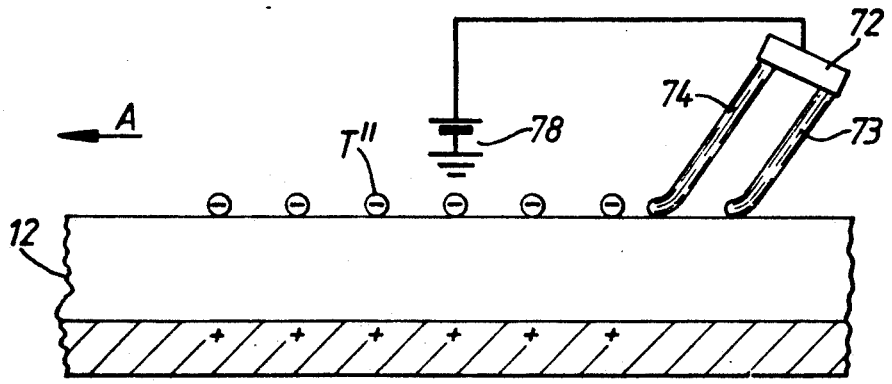

As shown in FIG. 4(*a*), there are residual toner particles T'' on the surface of image bearing member 12 moving in the direction of arrow A. The residual toner particles T'' are smoothed out when they pass underneath first brush member 73. Next, as shown in FIG. 4(*b*), residual toner particles T'' having a minus charge insufficient for transfer are attracted to first and second brush members 73 and 74 which has the AC bias voltage biased towards plus by power source 78. When image bearing member 12 advances further in the direction of arrow A, owing to the absence of a toner retaining capability on between first and second brush members 73 and 74, residual toner particles T'' attracted to first and second brush members 73 and 74 are naturally discharged at the rear of second brush member 74 as shown in FIG. 4(*c*). The amount of toner particles which may be held on first and second brush members 73 and 74 is small. Also, first and second brush members 73 and 74 are in contact with image bearing member 12 in the same direction as the rotation of image bearing member 12. Thus, although residual toner particles T'' are attracted to first and second brush members 73 and 74 by electrostatic force, residual toner particles T'' temporarily attracted to first and second brush members 73 and 74 are gradually deposited over other parts of the surface of image bearing member 12. Thereby, residual toner particles T'' are strewed over a wide area on the surface of image bearing member 12.

Figure 5A:
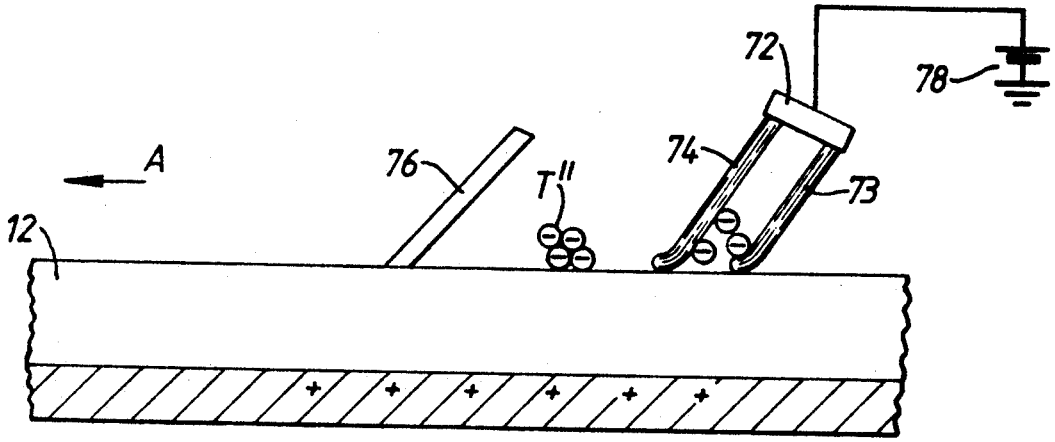
FIGS. 5(*a*)-(*b*) are diagrams showing the operation of a contact member of the disordering device shown in FIG. 3.
Figure 5B:
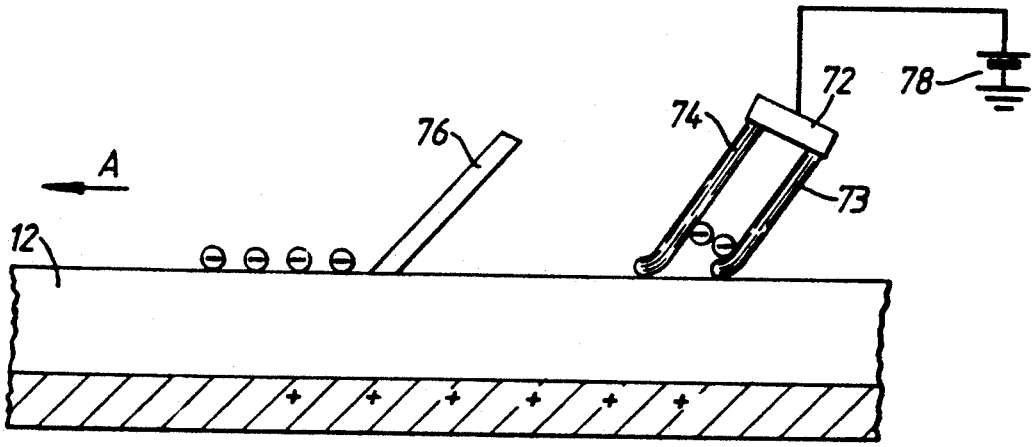

Next, the operation of contact member 76 of disordering device 18 will be described with reference to FIGS. 3 and 5.

As described above, disordering device 18 includes contact member 76 to level the lump of toner particles on image bearing member 12. Referring again to FIG. 3, contact member 76 is positioned on the downstream side of conductive member 72 in the direction of rotation of image bearing member 12. Also, contact member 76 is positioned on the upstream side of charging device 20 in the direction of image bearing member 12. Contact member 76 has the sheet-like material formed of urethane and so on. Also, the bottom end of contact member 76 is in sliding contact with image bearing member 12 in the same direction as the rotation of image bearing member 12. Moreover, since contact member 76 is located near charging device 20 when image bearing member 12 has a drum diameter of about 40 mm or less, charging leakage may occur. Thus, a surface 76*a* of contact member 76 facing charging device 20 is insulated.

In the disordering operation of disordering device 18, by sliding contact conductive member 72 with the surface of image bearing member 12, residual toner particles T'' are temporarily attracted to conductive member 72, and then the attracted toner is deposited over other parts of the surface of image bearing member 12. However, when body 14 of laser printer 10 vibrates in certain operations, for example, the operation for removing a jammed paper sheet from the apparatus, in the operation for starting the rotation of the image bearing member and so on, the toner particles attracted to conductive member 72 may be lumped and removed from conductive member 72 by this vibration as shown in FIG. 5(*a*). Thus, charging randomness and exposure randomness may be caused by the lump of toner particles removed from conductive member 72 in the next charging operation and latent image forming operation. Therefore, a resulting image formed on the image bearing member in the next image forming cycle is deteriorated.

On the contrary, in the present invention, contact member 76 is positioned on the downstream side of conductive member 72 in the direction of rotation of image bearing member 12 and is in sliding contact with image bearing member 12 in the same direction as the rotation of image bearing member 12. Thereby, contact member 76 may level the lump of toner particles removed from conductive member 72 on image bearing member 12 as shown in FIG. 5(*b*).

Accordingly, in the image forming apparatus of the present invention, when body 14 of laser printer 10 vibrates, any effects of the residual toner remaining on image bearing member 12 during the charging process and the latent image forming process are prevented by a simple construction.

In the above embodiment, a non-magnetic one-component developing device is used for making the apparatus most compact. However, the present invention is not limited to this apparatus. In the present invention, many other developing devices, e.g., a magnetic one-component developing device, a two-component developing device may also be employed.

Also, the above embodiment is described for the case where two conductive brush members 73 and 74 are provided in conductive member 72 of disordering device 18. However, the number of such brush members 73 and 74 may be one or three or more. Moreover, the parts of conductive member 72 are not restricted to brush members, but may be blade members, sponge-foam members and so on.

It should be understood that the detailed description and examples, while indicating presently preferred embodiments of the present invention, are given by way of illustration only. Various modifications and changes may be made to the present invention without departing from the scope or spirit of the invention, as set forth in the following claims.

What is claimed is:

1. An image forming apparatus comprising:

an image bearing member;

means for charging said image bearing member;

means for exposing the image bearing member charged by the charging means, to form a latent image on the image bearing member;

developing and cleaning means for developing the formed latent image with a developing agent and for simultaneously removing any previously deposited developing agent remaining on the image bearing member;

means for transferring the developed image on the image bearing member to a recording medium;

a plurality of conductive brush members in sliding contact with the surface of the image bearing member, for attracting the developing agent remaining on the image bearing members and distributing the attracted developing agent on the image bearing member, after transfer of the developed image by the transfer means;

means for applying a bias voltage to the conductive brush members; and a sheet-like contact member in sliding contact with the surface of the image bearing member and positioned between the brush members and the charging means for leveling any lumps of the developing agent remaining on the image bearing member after the image bearing member has passed the brush members.

2. An image forming apparatus of claim 1, wherein the developing and cleaning means includes an elastic roller constituting a developing and removing roller and positioned for sliding contact with the image bearing member, for supplying the developing agent to the image bearing member and simultaneously removing the developing agent remaining on the image bearing member.

3. An image forming apparatus comprising:

a rotatable image bearing member;

means for charging the image bearing member;

means for exposing the charged image bearing member to form a latent image thereon;

developing and cleaning means contained within a single unit, for developing the latent image formed on the image bearing member with a developing agent and simultaneously removing any previously deposited developing agent remaining on the image bearing member;

means for transferring the developed image on the image bearing member to a recording medium; and means for disordering the developing agent remaining on the image bearing members after transfer of the developed image by the transfer means;

the disordering means including:

a plurality of conductive brush members positioned to rub against the image bearing member, for attracting the developing agent remaining on the image bearing member and distributing the attracted developing agent on the image bearing member;

means for applying a bias voltage to the conductive brush members; and a sheet-like contact member in sliding contact with the surface of the image bearing member in the same direction as the rotation of the image bearing member and positioned on the downstream side of the conductive brush member in the direction of rotation of the image bearing member and on the upstream side of the charging means in the direction of rotation of the image bearing member, for leveling any lumps of the developing agent remaining on the image bearing member after the image bearing member has passed by the conductive brush members.

4. An image forming apparatus of claim 3, wherein the developing and cleaning means has an elastic roller constituting a developing and removing roller, positioned for sliding contact with the image bearing member, for supplying the developing agent to the image bearing member and for simultaneously removing the developing agent remaining on the image bearing member.

* * * * *